US008023880B2

(12) United States Patent
Terao et al.

(10) Patent No.: US 8,023,880 B2
(45) Date of Patent: Sep. 20, 2011

(54) SHEET POST-PROCESSING APPARATUS WITH BACK FEED PREVENTION

(75) Inventors: Yasunobu Terao, Izunokuni (JP); Mikio Yamamoto, Izunokuni (JP); Yoshiaki Sugizaki, Sunto-gun (JP); Hiroyuki Taki, Izunokuni (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 514 days.

(21) Appl. No.: 11/616,076

(22) Filed: Dec. 26, 2006

(65) Prior Publication Data

US 2007/0147924 A1 Jun. 28, 2007

(30) Foreign Application Priority Data

Dec. 26, 2005 (JP) ..... 2005-372752

(51) Int. Cl.
*B65H 29/34* (2006.01)
*B65H 29/52* (2006.01)

(52) U.S. Cl. ..... 399/407; 399/397

(58) Field of Classification Search ..... 271/109, 271/189, 292; 399/410, 404, 397, 405, 407; *B65H 29/34, 29/52*

See application file for complete search history.

(56) References Cited

U.S. PATENT DOCUMENTS

| | | | | |
|---|---|---|---|---|
| 4,209,917 | A * | 7/1980 | Johnson | 34/612 |
| 5,623,722 | A * | 4/1997 | Hawley et al. | 399/397 |
| 5,984,299 | A * | 11/1999 | Hirota et al. | 271/161 |
| 6,120,020 | A * | 9/2000 | Asao | 271/189 |
| 6,146,085 | A * | 11/2000 | Namba et al. | 414/789.9 |
| 6,698,744 | B2 * | 3/2004 | Yamada et al. | 270/58.12 |
| 2004/0181308 | A1 * | 9/2004 | Hayashi et al. | 700/223 |
| 2006/0066027 | A1 | 3/2006 | Terao et al. | |
| 2006/0066831 | A1 | 3/2006 | Terao et al. | |
| 2006/0067768 | A1 | 3/2006 | Terao et al. | |
| 2006/0078363 | A1 | 4/2006 | Terao et al. | |
| 2006/0157909 | A1 | 7/2006 | Terao et al. | |

FOREIGN PATENT DOCUMENTS

| | | | |
|---|---|---|---|
| JP | 62-284565 | | 5/1989 |
| JP | 09-267963 | | 10/1997 |
| JP | 10218476 | | 8/1998 |
| JP | 10218476 | A * | 8/1998 |
| JP | 2005075573 | | 3/2005 |
| JP | 2006111425 | A * | 4/2006 |

OTHER PUBLICATIONS

Japanese Office Action dated Jan. 19, 2010 corresponding to U.S. Appl. No. 11/616,076, filed Dec. 26, 2006.

* cited by examiner

*Primary Examiner* — Daniel J Colilla
*Assistant Examiner* — Jennifer Simmons
(74) *Attorney, Agent, or Firm* — Turocy & Watson, LLP

(57) ABSTRACT

The disclosure concerns a standby tray for making a sheet at the position above a processing tray. The sheet on the standby tray is dropped and supplied onto the processing tray. The upper end of the center area of a shutter supporting the rear end of the sheet on a sheet discharge tray which is slidable to the sheet discharge section of the standby tray or processing tray is made lower than the upper end of the peripheral area of the shutter. Movable portions of the shutter are extended when the sheet discharge tray is slid to close the sheet discharge sections of the processing tray and/or standby tray.

15 Claims, 13 Drawing Sheets

SHEET POST-PROCESSING APPARATUS WITH BACK FEED PREVENTION

CROSS-REFERENCE TO RELATED APPLICATION

This application is based upon and claims the benefit of priority from prior Japanese Patent Application No. 2005-372752 filed on Dec. 26, 2005, the entire contents of which are incorporated herein by reference.

BACKGROUND OF THE INVENTION

1. Field of the Invention

The present invention relates to a sheet post-processing apparatus that performs post-processing for a sheet on which an image has been formed in an image forming apparatus such as a copier, a printer, or a composite device.

2. Description of the Related Art

In recent years, there was developed a sheet post-processing apparatus, which is disposed adjacent to the sheet discharge section of an image forming apparatus main body for the purpose of performing post-processing for a sheet on which an image has been formed in the image forming apparatus. The sheet post-processing apparatus performs post-processing for a sheet, such as sorting of printed sheets discharged from the image forming apparatus or stapling thereof. The sheet post-processing apparatus performs post-processing for a succeeding sheet after completion of the post-processing for a preceding sheet. In order for the sheet post-processing apparatus to wait until the post-processing for a preceding sheet has been completed, an apparatus in which a retreating path is formed in the middle of a path reaching to a stapler is disclosed in Japanese Patent Publication (Kokoku) No. H6-99070.

However, in the case where the retreating path is formed in the middle of a path reaching to a stapler as described above, the length of a sheet path extending from the discharge section of the image forming apparatus main body to the stapler is increased. This may prevent size reduction of the entire apparatus.

In light of the above, an apparatus in which a processing tray for use in staple processing and a standby tray which retains a sheet to be supplied to the processing tray in a standby mode are vertically provided to reduce the length of the sheet path has been proposed. In this apparatus, a sheet is dropped from the standby tray and is supplied onto the processing tray. Further, such an apparatus has a sheet discharge tray on which a sheet discharged from the standby tray or processing tray is placed and a rear end guide that supports the rear end of the sheet on the discharge tray between the discharge tray.

However, if deformation of a sheet occurs when the sheet is discharged from the standby tray or processing tray to the sheet discharge tray, the sheet is caught by the rear side which may result in sheet jamming. Further, if the rear guide contacts a sheet when the sheet is aligned on the processing tray, the rear guide serves as resistance too adversely affecting the sheet alignment performance.

Further, in some cases, the sheet discharge tray is slid on the side surface of the post-processing apparatus main body, with the sheet placed thereon, so as to be disposed adjacent to the position of the standby tray or processing tray. If the rear end of the sheet on the discharge tray is slipped from the upper end of the rear guide at this time, the sheet may be fed back to the processing tray or standby tray side.

To cope with the above problems, a small-sized sheet post-processing apparatus that prevents sheet jamming from occurring when the sheet is discharged from the standby tray or processing tray to the discharge tray without adversely affecting the sheet alignment performance made in the processing tray has been desired. Further, a sheet post-processing apparatus that prevents the sheet placed on the discharge tray from being fed back to the backside at the time of the slide of the discharge tray has been desired.

SUMMARY OF THE INVENTION

An aspect of the present invention is to provide a sheet post-processing apparatus in which a sheet is dropped from the standby tray to thereby be supplied to the processing tray and the length of a sheet path is reduced. It is desirable for the sheet post-processing apparatus to prevent sheet jamming from occurring when the sheet is discharged to the discharge tray, to exhibit an excellent sheet alignment performance on the processing tray, and to prevent the sheet placed on the discharge tray from reversely being fed to the processing tray side at the time of the slide of the discharge tray.

According to an embodiment of the present invention, a sheet post-processing apparatus is characterized by containing: a standby tray for making a sheet discharged from an image forming apparatus stand by, a processing tray arranged under the standby tray, a processing mechanism for performing post-processing for the sheet, a sheet discharge tray for loading the sheet, the sheet discharge tray being slidably arranged adjacent to the standby tray or the processing tray on the downstream side with respect to the standby tray and processing tray in the sheet discharge direction and tilted such that the discharge direction front end of the sheet is positioned higher than the discharge direction rear end thereof, and a rear end supporting mechanism arranged on the discharge direction rear end side and allows the rear end of the sheet on the sheet discharge tray to be brought into contact therewith, wherein the center area upper end of the rear end supporting mechanism is positioned lower than the peripheral area upper end of the rear end supporting mechanism.

DETAILED DESCRIPTION OF THE PREFERRED EMBODIMENTS

Figure 1:
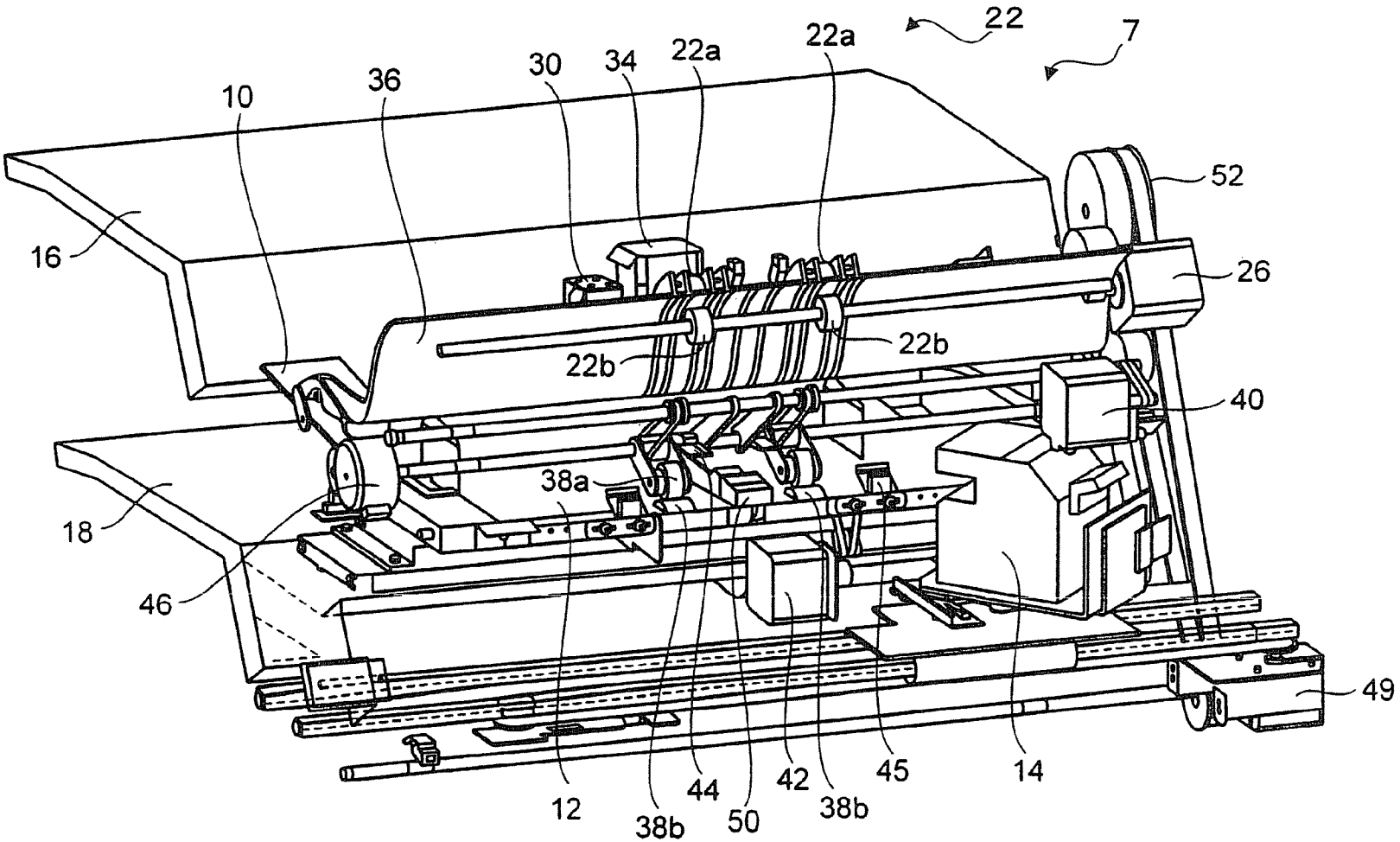
FIG. 1 is a perspective view showing the main part of a sheet post-processing apparatus according to an embodiment of the present invention.
Figure 2:
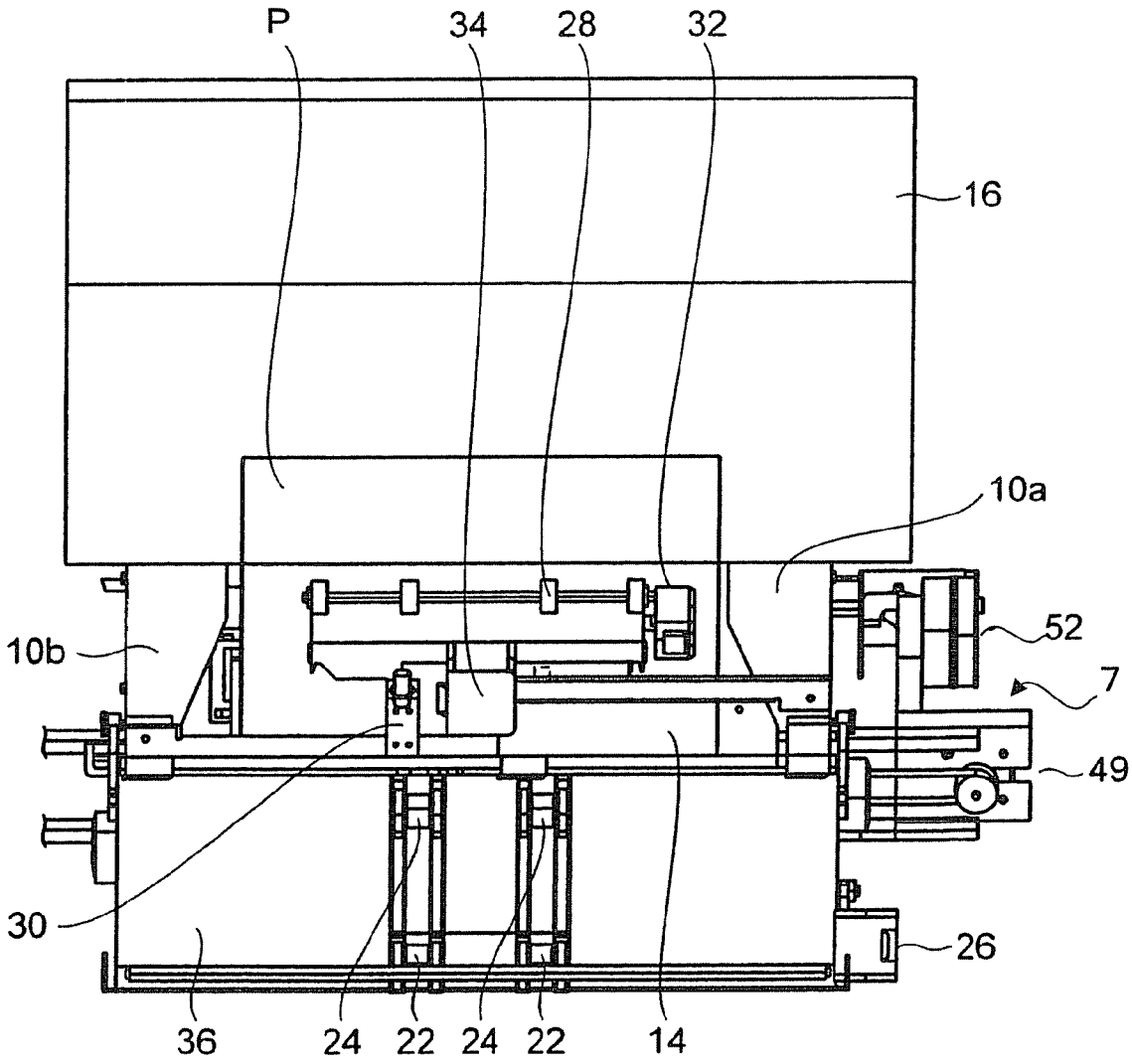
FIG. 2 is a top view of the main part of the sheet post-processing apparatus according to the embodiment of the present invention.
Figure 3A:
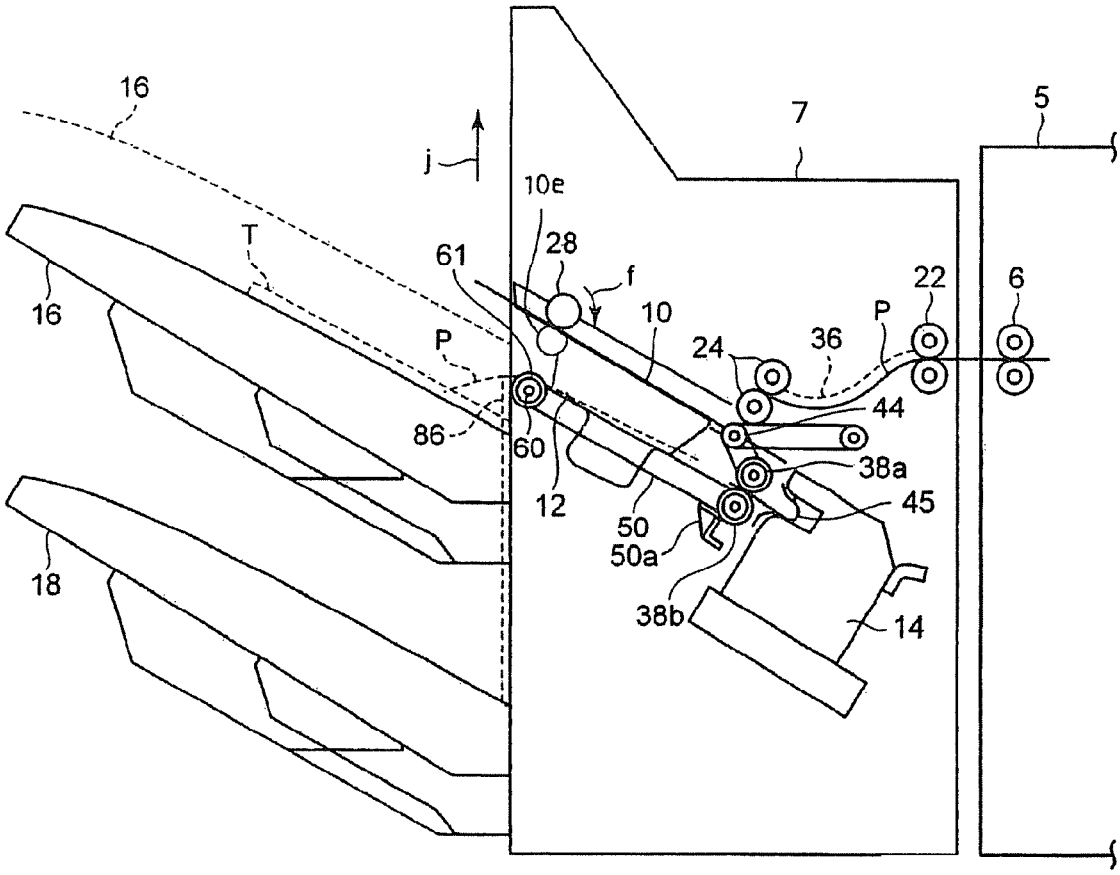
FIG. 3A is a view schematically showing a configuration of the sheet post-processing apparatus according to the embodiment of the present invention in a state where a sheet is discharged onto a first sheet discharge tray.
Figure 3B:
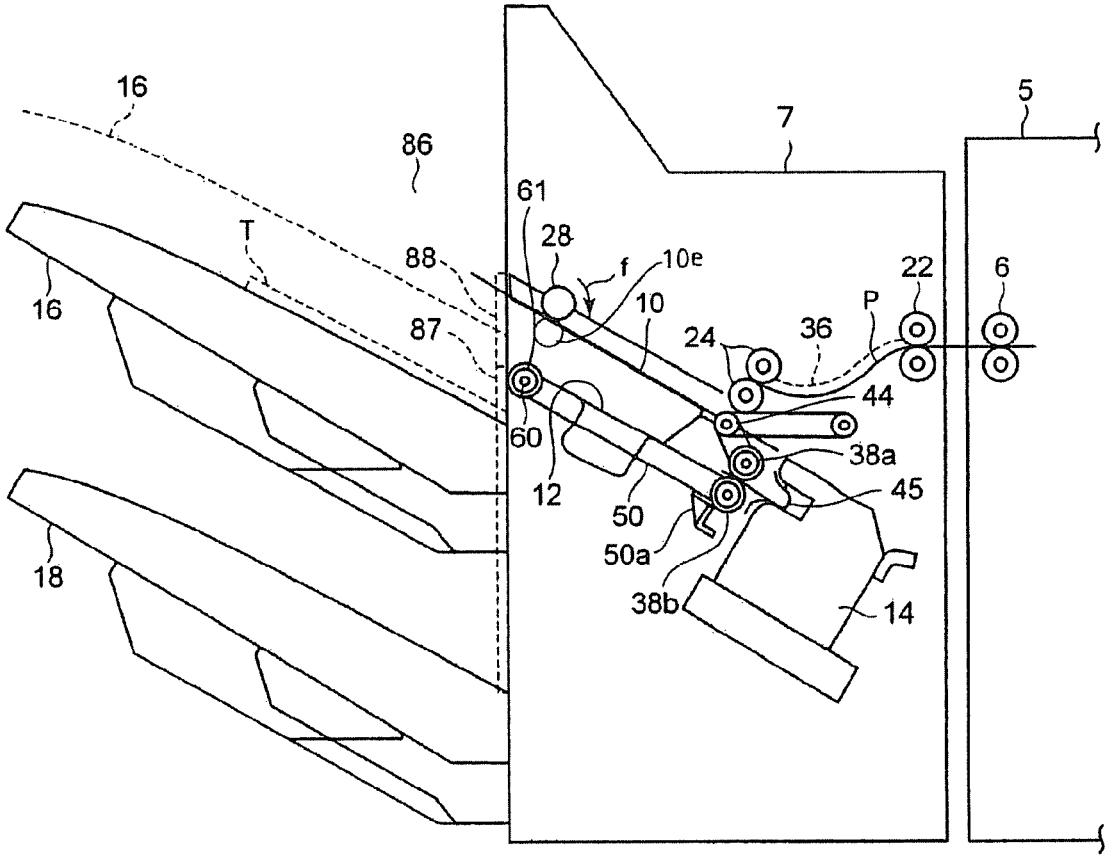
FIG. 3B is a view schematically showing a configuration of the sheet post-processing apparatus according to the embodiment of the present invention in a state where the sheet discharge tray is slid.

Hereinafter, an embodiment of the present invention will be described in detail with reference to the accompanying drawings. FIG. 1 is a perspective view showing the main part of a sheet post-processing apparatus 7 according to an embodiment of the present invention. FIG. 2 is a top view of the main part of the sheet post-processing apparatus 7. FIGS. 3A and 3B are views each schematically showing a configuration of the sheet post-processing apparatus 7 disposed adjacent to an image forming apparatus 5 such as a copier.

The sheet post-processing apparatus 7 has a pair of entrance rollers 22 have an upper roller 22*a* and lower roller 22*b* that feed a sheet P, on which an image has been formed by the image forming apparatus 5 and which is discharged by a pair of discharge rollers 6, into the sheet post-processing apparatus 7. The entrance rollers 22 are driven by an entrance roller motor 26. Between the entrance rollers 22 and a standby tray 10, a sheet path ceiling 36 for leading the sheet P to a pair of sheet feed rollers 24 is installed. Under the standby tray 10, a processing tray 12 for loading the sheets P dropped and supplied from the standby tray 10 is arranged.

Figure 4:
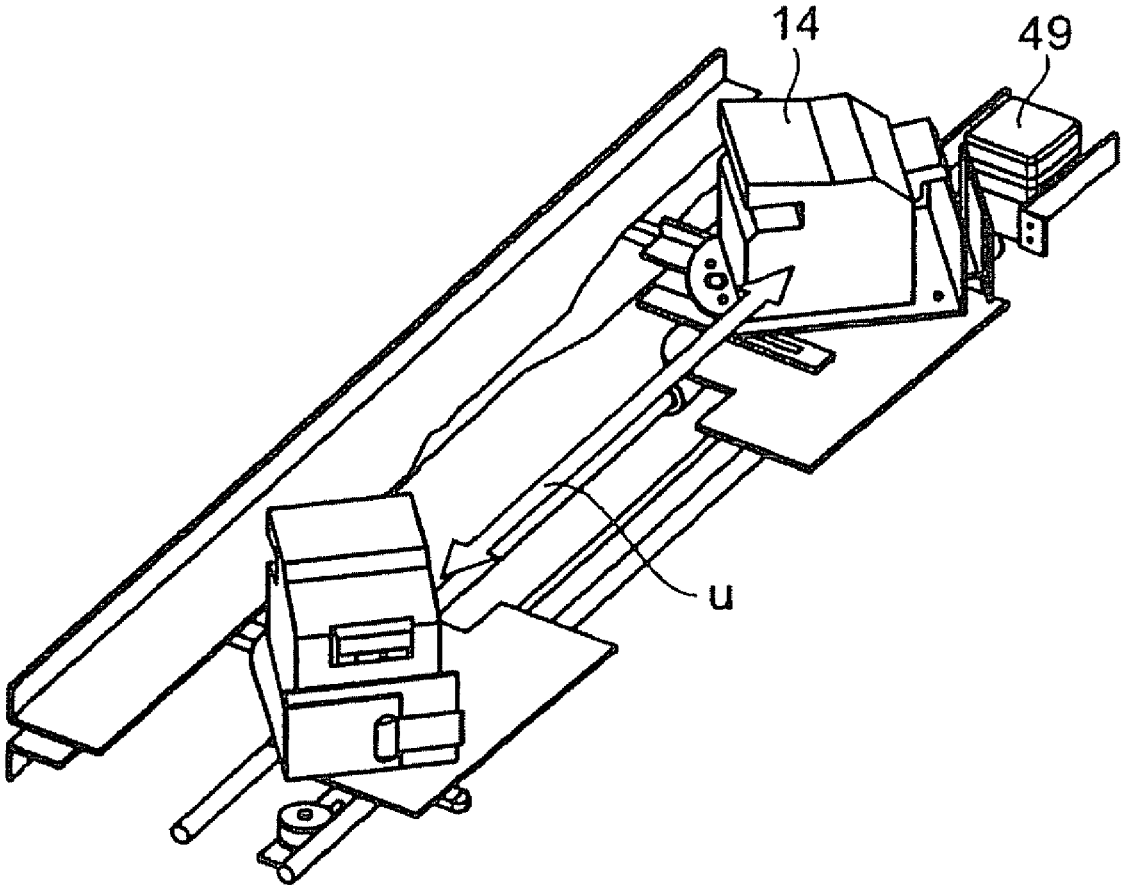
FIG. 4 is a perspective view showing a stapler of the sheet post-processing apparatus according to the embodiment of the present invention.

While the sheets P are stapled by a stapler 14 which is a processing mechanism for performing post-processing, the processing tray 12, supports the sheets P to be loaded in an aligned state. As shown in FIG. 4, the stapler 14 is slidable by a staple drive section 49 in u direction denoted by the arrow in the illustration. The stapler 14 performs staple processing after being rotated in accordance with the staple direction and positioned. The processing tray 12 has a pair of vertical alignment roller 38*a* and lower vertical alignment roller 38*b* shown in FIG. 5 at the rear end side portion of the sheet P.

The upper vertical alignment roller 38*a* and lower vertical alignment roller 38*b* align a plurality of sheets P dropped and supplied from the standby tray 10 in the vertical direction which is a feeding direction. The upper and lower vertical alignment rollers 38*a* and 38*b* serve as bundle feeding rollers for holding a sheet bundle T after stapled and taking out it from the stapler 14. The upper vertical alignment roller 38*a* is driven by a vertical alignment upper roller motor 40. The lower vertical matching roller 38*b* is driven by a vertical alignment lower roller motor 42.

Figure 6:
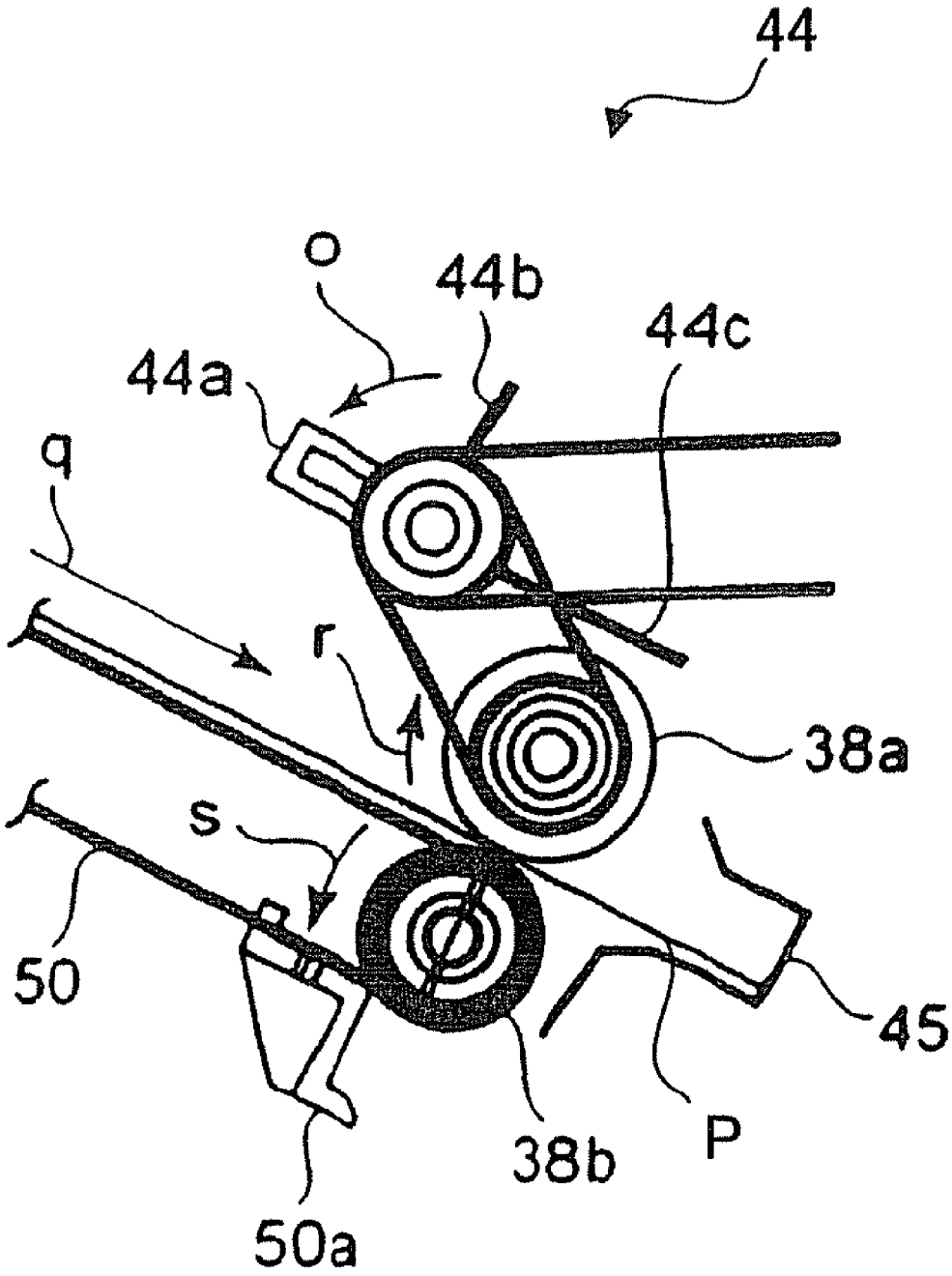
FIG. 6 is a perspective view showing a paddle mechanism according to the embodiment of the present invention.

At the position opposite to the rear end of each of the sheets P which have been dropped and supplied from the standby tray 10 onto the processing tray 12, a paddle 44 is arranged. The paddle 44, which is configured to be rotatable, aligns vertically the uppermost sheet P loaded on the processing tray 12. The paddle 44, as shown in FIG. 6, has a receiving portion 44*a* for receiving the sheets P dropped and supplied onto the processing tray 12 from the standby tray 10, a beating portion 44*b* for beating down the sheets P on the processing tray 12, and a feeding portion 44*c* for aligning the sheets P on the processing tray 12. The paddle 44 is driven by a paddle motor 46. The paddle 44 is composed of an elastic rubber material and has elasticity.

At the end of the processing tray 12 on the side of the stapler 14, a stopper 45 for making contact with the rear end of each of the sheets P and vertically aligning the rear end position is arranged. Almost at the center of the processing tray 12, a conveyor belt 50 serving as a sheet discharge mechanism is installed. The conveyer belt 50 feeds the sheet bundle T, which is stapled and taken out from the stapler 14 by the upper and lower vertical alignment rollers 38*a* and 38*b*, to first or second sheet discharge tray 16 or 18. To the conveyer belt 50, a feed pawl 50*a* for hooking the rear end of the sheet bundle T is attached. The first or second sheet discharge tray 16 or 18 is configured to be slidable on the side surface of the sheet post-processing apparatus 7 in the vertical direction.

At the end of the processing tray 12 on the side of the sheet discharge tray 16 or 18, pluralities of alignment rollers 61 are arranged. The alignment rollers 61 are supported by a shaft 60 and contact the bottom surface of the sheet P. The alignment rollers 61 have a pair of center alignment rollers 61*a* which are disposed symmetrically with respect to the conveyor belt 50 and a pair of side alignment rollers 61*b* which are disposed on both sides of the center alignment rollers 61*a*.

Figure 5:
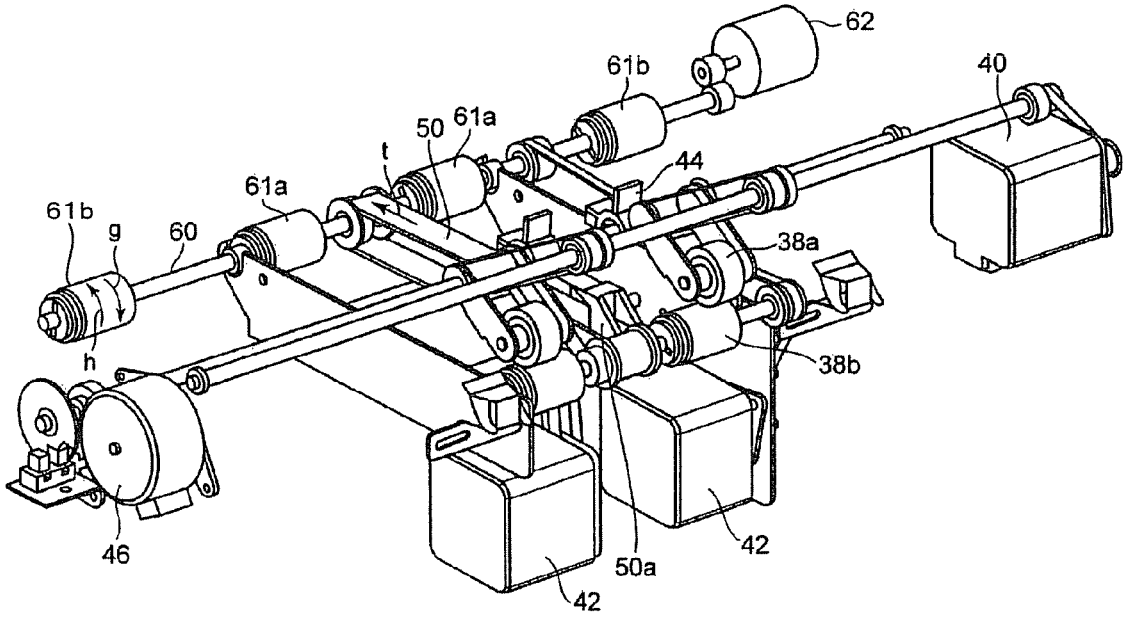
FIG. 5 is an explanatory view showing vertical alignment rollers according to the embodiment of the present invention.

The alignment rollers 61 are rotated in g direction (first direction) denoted by the arrow in FIG. 5 to thereby feed the sheet P to the stopper 45 side so as to allow the rear end of the sheet P to contact with the stopper 45, thereby vertically aligning the sheet P. On the other hand, when the alignment rollers 61 are rotated in h direction (second direction opposite to the first direction) denoted by the arrow in FIG. 5, the sheet P is fed to the sheet discharge tray 16 or 18 sides. The alignment rollers 61 and conveyer belt 50 use the same shaft 60. The shaft 60 is made rotatable in forward and reverse directions by a belt motor 62. The conveyer belt 50 is driven through a one-way clutch (not shown) and therefore is rotatable only in t direction denoted by the arrow in FIG. 5.

Figure 7:
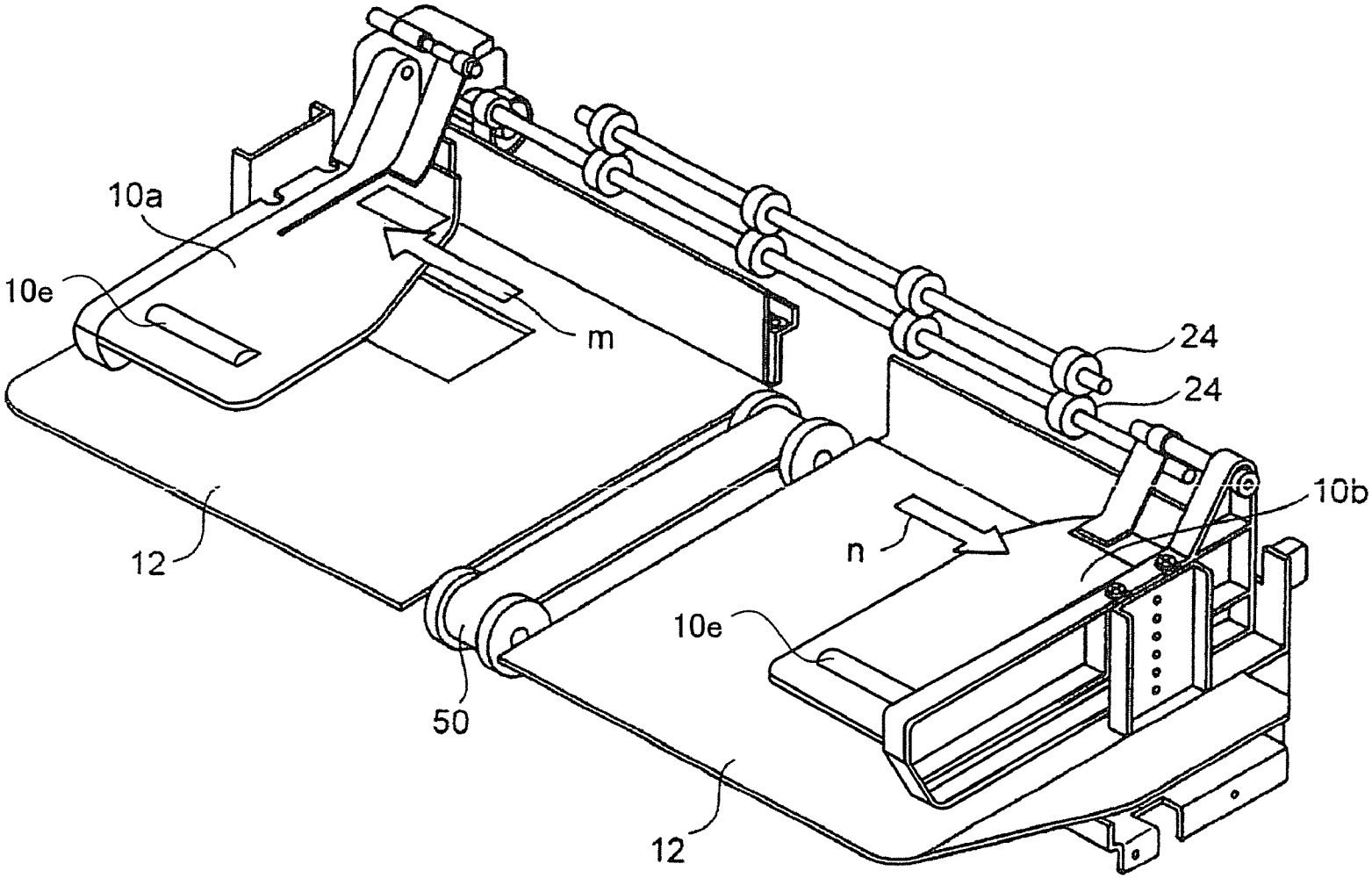
FIG. 7 is a perspective view schematically showing a standby tray and a processing tray according to the embodiment of the present invention.
Figure 8:
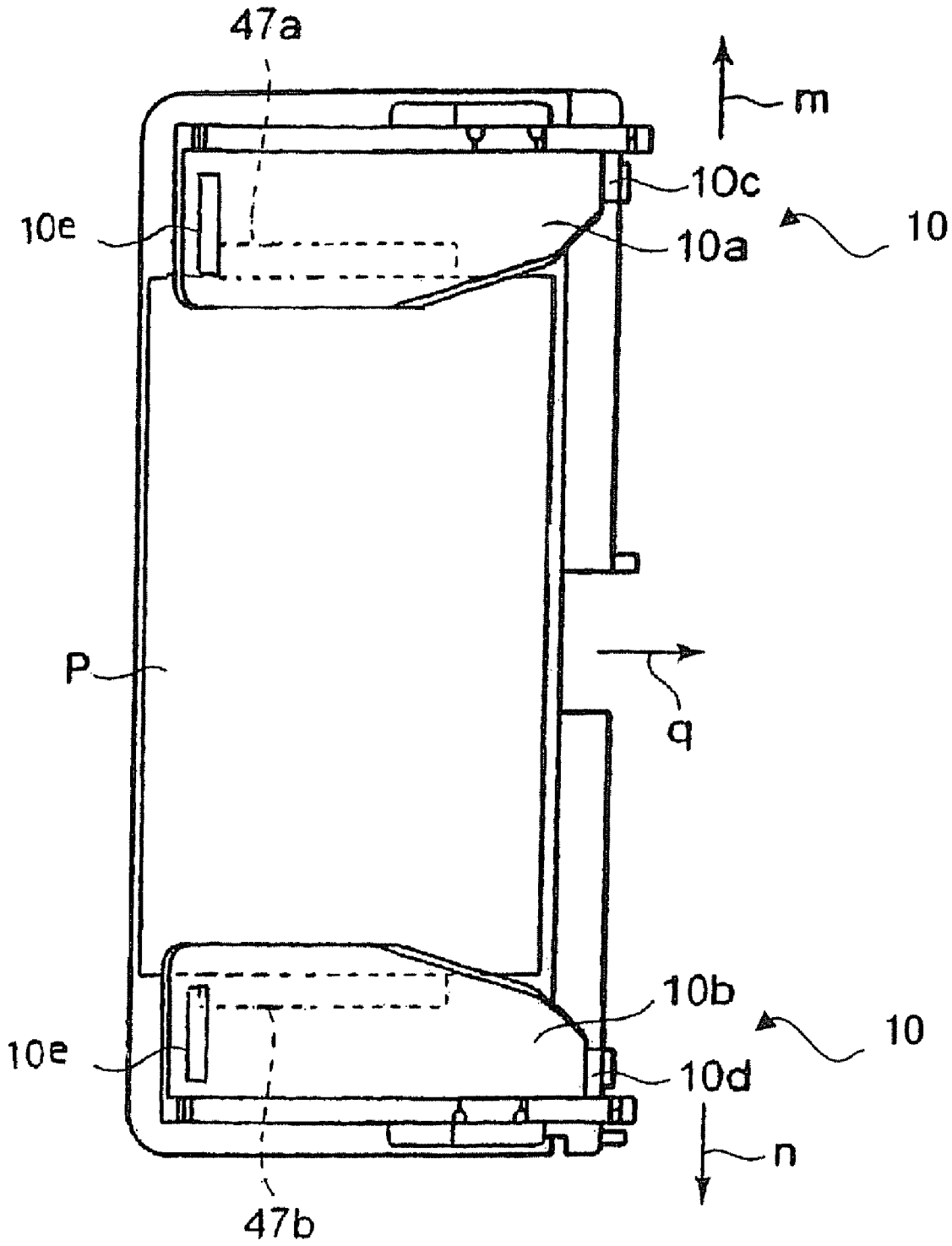
FIG. 8 is a top view of the standby tray and processing tray according to the embodiment of the present invention.

The standby tray 10 can drop and supply the sheets P onto the processing tray 12 and also can feed the sheets P toward the first or second sheet discharge tray 16 or 18. The standby tray 10 is so tilted as to support the sheets P such that the position of the front ends of the sheets P becomes higher than that of the rear ends thereof. As shown in FIGS. 7 and 8, the standby tray 10 has a pair of tray members 10*a* and 10*b*. The tray members 10*a* and 10*b* receive the sheets in a state that they slide in the width of the sheet P and support both sides of the sheet P. On the tray members 10*a* and 10*b*, standby stoppers 10*c* and 10*d* for aligning the rear ends of the sheets P are installed. The standby tray 10 slides and moves by a standby tray motor 34.

The standby tray 10 has pinch rollers 10*e* which hold the sheet P on the standby tray 10 between themselves and standby tray rollers 28 provided for aligning the sheet P and feed it toward the sheet discharge tray 16 or 18. Note that, without providing the pinch roller 10*e*, it is possible to feed the sheet P on the standby tray 10 toward the sheet discharge tray 16 or 18 only by the standby tray rollers 28. The standby rollers 28 are controlled by a standby tray roller drive source 30 in terms of their vertical movement and rotated by a standby tray roller motor 32.

Figure 9:
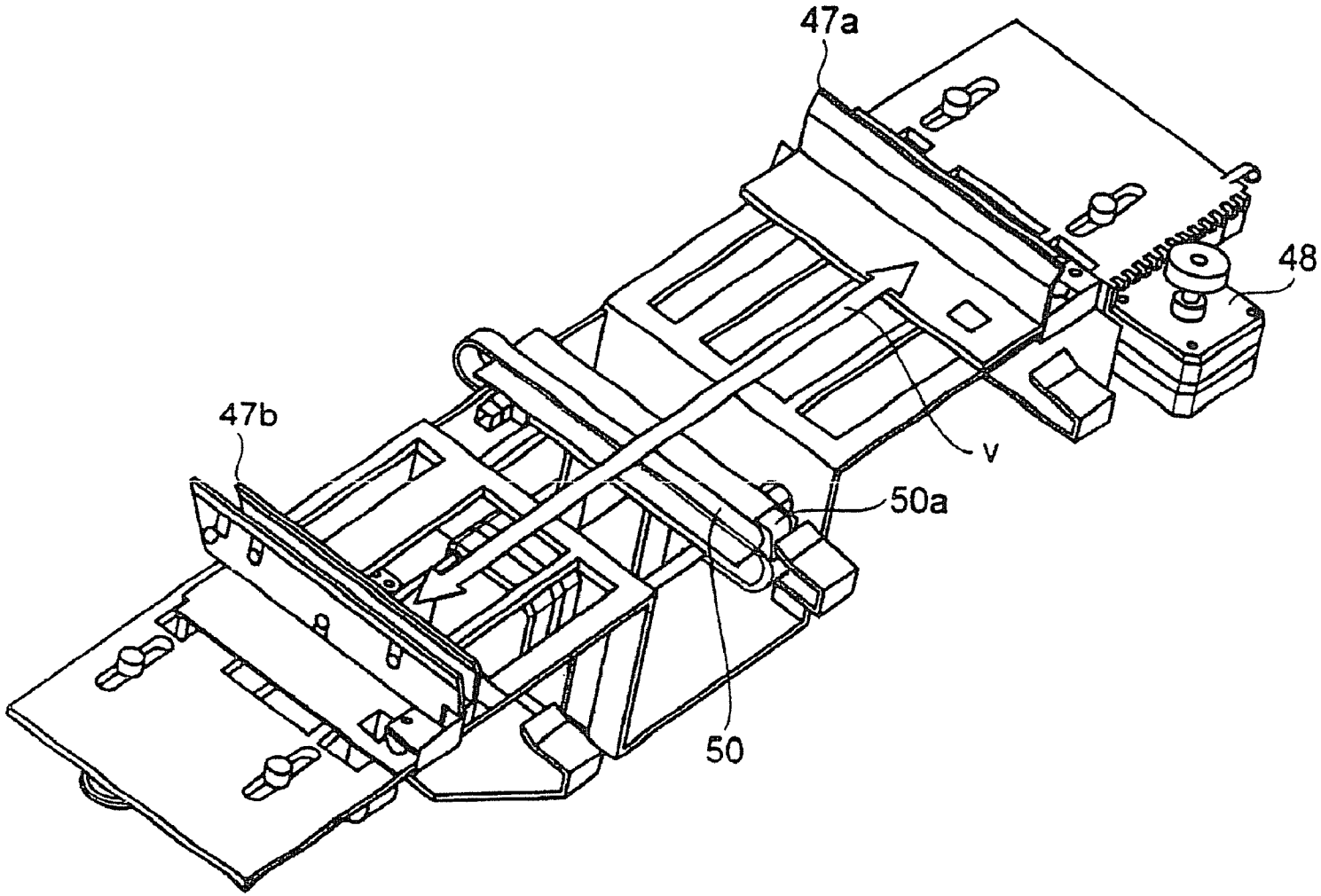
FIG. 9 is a perspective view schematically showing horizontal alignment plates and a conveyer belt according to the embodiment of the present invention.

Between the standby tray 10 and the processing tray 12, horizontal alignment plates 47*a* and 47*b* shown in FIG. 9 are installed. When the sheets P are dropped and supplied from the standby tray 10 onto the processing tray 12, the horizontal alignment plates 47*a* and 47*b* prevent the sheets P from turning away in the horizontal direction perpendicular to the feeding direction and horizontally align them. The horizontal alignment plates 47*a* and 47*b* are formed slidably in v direction denoted by the arrow so as to fit to the width of the sheets P by a horizontal alignment motor 48.

The first or second sheet discharge tray 16 or 18 is so tilted as to support the sheets P such that the position of the front ends of the sheets P becomes higher than that of the rear ends thereof. One of the first and second sheet discharge trays 16 and 18 is selected, and the selected one is moved up and down by a sheet discharge drive section 52. The first or second sheet discharge tray 16 or 18 is moved up and down up to almost the same height as that of the sheet discharge section of the standby tray 10 or processing tray 12 when loading the sheets P to improve the consistency of the sheets P to be discharged. That is, the sheets P are not disturbed due to a difference in vertical positions.

Figure 10:
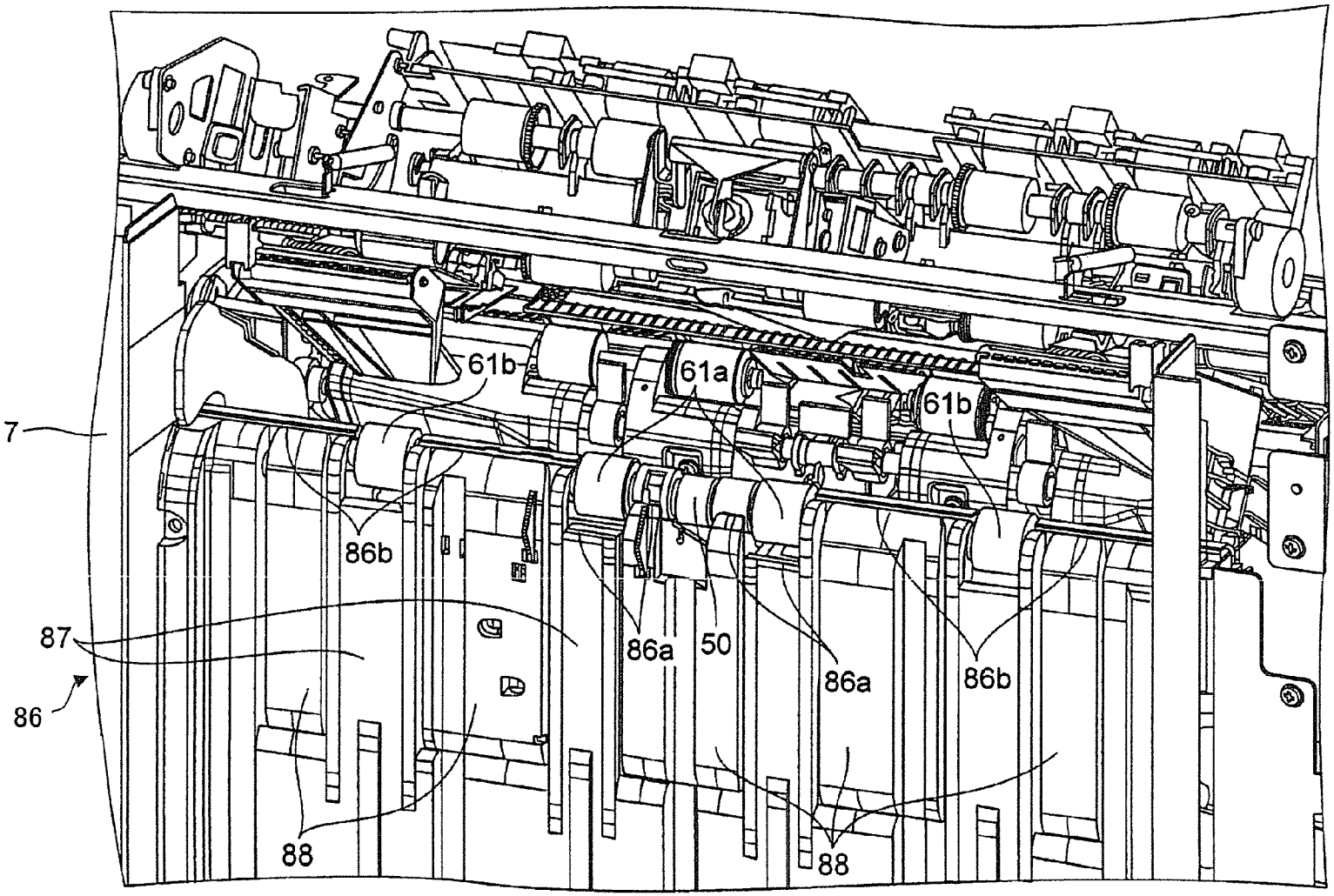
FIG. 10 is a perspective view schematically showing a part of a shutter according to the embodiment of the present invention in a state where a sheet is discharged onto the first sheet discharge tray.
Figure 11:
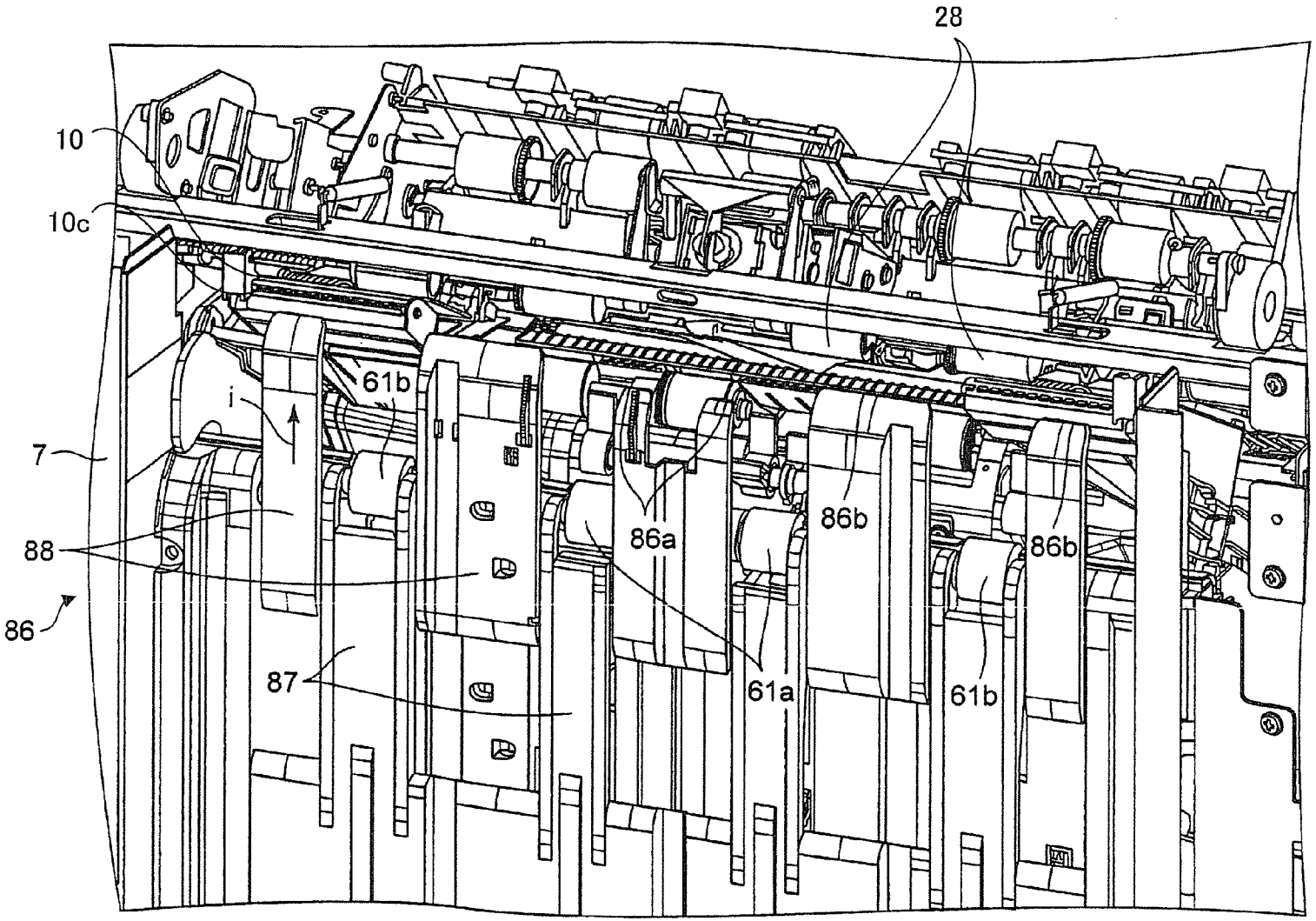
FIG. 11 is a perspective view schematically showing a part of the shutter according to the embodiment of the present invention in a state where the sheet discharge tray is slid.

At the position below the sheet discharge section of the processing tray 12 and between the processing tray 12 and sheet discharge trays 16, 18, a shutter 86 which is a rear end supporting mechanism for supporting the rear end of the sheet P discharged onto the sheet discharge trays 16 and 18 is provided. As shown in FIGS. 10 and 11, the shutter 86 has stationary portions 87 and movable portions 88. The movable portions 88 can be extended relative to the stationary portions 87 and can be contracted to overlap the stationary portions 87 for housing.

When the sheet P is discharged from the processing tray 12 onto the first or second sheet discharge tray 16 or 18, the movable portions 88 are contracted to overlap the stationary portions 87, as shown in FIG. 10. At this time, the upper end of the movable portions 88 lies at substantially the same height as the upper end of the stationary portions 87 of the shutter 86.

In a state where the movable portions 88 are contracted, center upper portions 86*a*, which are upper ends of the center area that faces center alignment rollers 61*a* of the shutter 86, are located lower than the peripheral upper portions 86*b* which are upper ends of the peripheral area. This configuration allows the center alignment rollers 61*a* to be completely exposed from the upper end of the shutter 86. Therefore, the center portion of the sheet P that has run over the processing tray 12 and hung there from, contacts the center alignment rollers 61*a* without fail.

When the first or second sheet discharge tray 16 or 18 is slid, the movable portions 88 of the shutter 86 are extended. At this time, the movable portions 88 of the shutter 86 are slid in i direction denoted by the arrow in FIG. 11 while being guided by the stationary portions 87. The extension/contraction of the moveable portions 88 of the shutter 86 is controlled by a belt motor 62 for driving the alignment rollers 61 and conveyer belt 50. The movable members 88 has a rack-and pinion mechanism which is driven by a link mechanism for transferring the drive of the belt motor 62 to the rack. The link mechanism has an electromagnetic clutch and controls ON/OFF of the electromagnetic clutch to thereby transfer the drive of the belt motor 62 to the pinion.

When the electromagnetic clutch is turned ON while the belt motor 62 drives the alignment rollers 61 in h direction denoted by the arrow in FIG. 5, the movable portions 88 are slidably extended in i direction denoted by the arrow in FIG. 11. On the other hand, when the electromagnetic clutch is turned ON while the belt motor 62 drives the alignment rollers 61 in g direction denoted by the arrow in FIG. 5, the movable portions 88 are slid in the direction opposite to the i direction to be contracted. The movable portions 88 can be extended up to the front face of the sheet discharge section of the processing tray 12 and, further, up to the front face of the sheet discharge section of the standby tray 10 to thereby close the sheet discharge sections of the processing tray 12 and standby tray 10. This prevents the sheet P on the sheet discharge tray 16 or 18 from reversely being fed to the processing tray 12 or standby tray 10 when the sheet discharge tray 16 or 18 is slid upward with the sheets P loaded thereon.

Next, the operation of the present invention will be described. When the sheet is discharged from the processing tray 12 of the sheet post-processing apparatus 7, the shutter 86 is located below the sheet discharge section of the processing tray 12, as shown in FIG. 3A. In this state, the sheet P which has been discharged onto the sheet discharge tray 16 or 18 is supported by the shutter 86 at the rear end thereof. When the sheet discharge tray 16 or 18 is slid, the shutter 86 closes the front face of the sheet discharge sections of the processing tray 12 and standby tray 10 to thereby prevent the sheet P on the sheet discharge tray 16 or 18 from reversely being fed to the processing tray 12 or standby tray 10, as shown in FIG. 3B.

After an image has been formed on a sheet P in the image forming apparatus 5, the sheet P on which an image has been formed is discharged by the sheet discharge roller 6 of the image forming apparatus 5 to the sheet post-processing apparatus 7. When receiving the sheet P, the sheet post-processing apparatus 7 performs a different operation, depending on a case of performing the post-processing of the sheet P or a case of performing no post-processing. Or the sheet post-processing apparatus 7 performs a different operation, depending on a case of that the preceding sheet P is in execution of the post-processing or that is finished it.

When the post-processing is not to be performed, the sheet P which has been fed from the entrance rollers 22 to the sheet feed rollers 24 through the sheet path ceiling 36 is fed to the standby tray 10 by the paper feed rollers 24. Then, the sheet P is moved down onto the standby tray 10 and is fed while being held between the standby tray rollers 28 rotated in the direction of the arrow f and pinch rollers 10*e* of the standby tray 10 to be discharged onto the first sheet discharge tray 16 from the sheet discharge section of the standby tray 10.

At this time, the sheet discharge tray 16 is slid from substantially the same height position as the sheet discharge section of the processing tray 12 in the direction of the arrow j up to substantially the same height position as the sheet discharge section of the standby tray 10, as denoted by the dotted line in FIG. 3B. At the same time, the movable portions 88 are extended in the direction of the arrow i such that the upper portions 86*a* and 86*b* thereof reach the position below the sheet discharge section of the standby tray 10.

As a result, the sheet P on the sheet discharge tray 16 which has been discharged from the standby tray 10 is supported by the extended movable portions 88 of the shutter 86 at the rear end thereof. The movable portions 88 are extended by the ON operation of the electromagnetic clutch while the belt motor 62 rotates the alignment rollers 61 in the direction of the arrow h. At this time, the shutter 86 is contracted such that the center upper portions 86*a* become lower than the peripheral upper portions 86*b*. Therefore, even if the sheet P is discharged from the standby tray 10 in a state where its center portion in the feeding direction is deformed, the deformed portion is not brought into contact with the shutter 86, thereby avoiding jamming of the sheet P.

In this way, on the first sheet discharge tray 16, sheets P directly discharged from the standby tray 10 are sequentially loaded. The first sheet discharge tray 16 is arranged in a tilted manner such that the front end of the sheet P is positioned higher than the rear end thereof, so that, the preceding sheet P loaded on the first sheet discharge tray 16 is not pressed out by making contact with the front end of the succeeding sheet P. Namely, the discharged sheet P is sequentially loaded on the first sheet discharge tray 16 unless the order is disturbed. Even if the preceding sheet P is pressed by the succeeding sheet P and is slightly displaced, the sheet P drops by its own weight to the shutter 86 side. Therefore, the rear ends of the sheets P are brought into contact with the shutter 86 on the first sheet discharge tray 16 and thereby the alignment of the sheets P is accomplished.

When the first sheet discharge tray 16 is full, the first and second sheet discharge trays 16 and 18 are slid in the direction of the arrow j so that the sheet P is discharged onto the second sheet discharge tray 18. The movable portions 88 of the shutter 86 are further extended before the slide of the first and second sheet discharge trays 16 and 18 to close the sheet discharge section of the standby tray 10.

Therefore, it is possible to prevent the sheet P placed on the first sheet discharge tray 16 from reversely being fed to the standby tray 10 when the first sheet discharge tray 16 passes the front face of the standby tray 10. After the second sheet discharge tray 18 is slid up to the position corresponding to the sheet discharge section of the standby tray 10, the movable portions 88 are contracted so that the upper portions 86*a* and 86*b* of the shutter 86 are positioned below the sheet discharge section of the standby tray 10 to open the sheet discharge section of the standby tray 10. In this state, the sheet P can be discharged from the standby tray 10 onto the second sheet discharge tray 18.

Next, a case where staple processing which is a post-processing is to be performed and no preceding sheets P in execution of the staple processing remain on the processing tray 12 will be described. At this time, the standby tray 10 slides and moves the tray members 10*a* and 10*b* respectively up to the positions indicated by the dotted lines in FIG. 12 in the directions of arrows m and n to open the dropping and supplying path of the sheet P. The horizontal alignment plates 47*a* and 47*b*, to align the sheet P dropping from the sheet feed rollers 24 in the horizontal direction, are arranged so that the gap between the horizontal alignment plates 47*a* and 47*b* is made almost equal to the width of the sheet P. By doing this, the sheet P fed by the sheet feed rollers 24, without the feeding being obstructed by the standby tray 10, is dropped and supplied directly onto the processing tray 12.

At the time of dropping and supplying, the upper vertical alignment roller 38*a* is shifted upward. Both sides of the sheet P drop in contact with the horizontal alignment plates 47*a* and 47*b* and are aligned in the horizontal direction. The rear end of the first sheet P dropped and supplied onto the processing tray 12 is placed on the receiving portion 44*a* of the paddle 44, and the front end thereof is contact with the alignment rollers 61. Then, the paddle 44 rotates in the direction of the arrow o, drops the rear end of the sheet P from the receiving portion 44*a*, and beats down it onto the processing tray 12 by the beating portion 44*b*. Furthermore, the paddle 44 feeds the sheet P in the direction of the arrow q by the feeding portion 44*c*. At the same time, the sheet P is fed toward the stopper 45 by the alignment rollers 61 rotated in the direction of the arrow g, and the rear end of the sheet of paper P is brought into contact with the stopper 45, and the vertical alignment of the sheet P is accomplished.

When the sheet P is vertically aligned on the stopper 45 side, the front end of the sheet P hangs outward from the sheet post-processing apparatus 7 as denoted by the dotted line in FIG. 3A. At this time, the back surface of the sheet P is contact with the alignment rollers 61 and upper portions 86*a* and 86*b* of the shutter 86. The contact with shutter 86 offers a resistance to the vertical alignment of the sheet P.

However, the vertical positions of the center upper portions 86*a* of the shutter 86 are lower than those of the peripheral upper portions 86*b* disposed on both sides of the center upper portions 86*a*, so that the central alignment rollers 61*a* are completely projected upward from the center upper portions 86*a* of the shutter 86. That is, at the center area, the sheet P is contact with the center alignment rollers 61*a* without fail without being affected by a resistance of the shutter 86. Particularly, in the case of the sheet P having a large size such as A3 (JIS standard), the center portion thereof in the feeding direction is easily deformed. However, even if the center portion of the sheet P has been deformed, the sheet P can surely receive a feeding force from the center alignment rollers 61*a* without being affected by a resistance of the shutter 86. Thus, the sheet P obtains a satisfactory vertical alignment by the alignment rollers 61.

After that, the second or subsequent sheet P is dropped onto the processing tray 12 with both sides thereof brought into contact with the horizontal alignment plates 47*a* and 47*b* for horizontal alignment. The second or subsequent sheet P is, after the rear end thereof is dropped onto the receiving portion 44*a* of the paddle 44, fed to the stopper 45 sides only by the rotation of the paddle 44. The rotation of the paddle 44 brings the rear end of the sheet P into contact with the stopper 45, thereby accomplishing the vertical alignment of the sheet P. The vertical alignment of the sheet P on the processing tray 12 may be performed by moving up and down the vertical alignment roller 38*a* for each alignment operation and by rotating it in the opposite direction to the arrow r.

In this way, the sheet P on which an image has been formed is loaded directly on the processing tray 12 from the sheet feed rollers 24 while sequentially being aligned in the horizontal direction and vertical direction. When the sheets P reach a predetermined number, the stapler 14 staples the sheets P on the processing tray 12 at a desired position and bundles them to form the sheet bundle T. Thereafter, the upper vertical alignment roller 38*a* is moved down onto the sheet bundle T. The sheet bundle T is then held between the upper vertical alignment roller 38*a* rotated in the direction of the arrow r and the lower vertical alignment roller 38*b* rotated in the direction of the arrow s and is fed toward the first sheet discharge tray 16.

When the rear end of the sheet bundle T passes the upper and lower vertical alignment rollers 38*a* and 38*b*, it is hooked by the feed pawl 50*a* of the conveyor belt 50 rotated in the direction of the arrow t and is sent to the first sheet discharge tray 16. At this time, the alignment rollers 61 are rotated in the direction of the arrow h. As a result, the sheet bundle T is fed to the sheet discharge tray 16 or 18 side by feeding forces of both the conveyer belt 50 and alignment rollers 61. Since the conveyer belt 50 and alignment rollers 61 use the same shaft 60, they are always driven at the same time. That is, the feeding forces supplied from the conveyer belt 50 and alignment rollers 61 are continued to be applied to the sheet bundle T. As a result, the sheet bundle T is smoothly and stably fed by means of both the conveyer belt 50 and alignment rollers 61 onto the sheet discharge tray 16 or 18.

The first sheet discharge tray 16 is arranged in a tilted manner and therefore the front end of the sheet P is positioned higher than the rear end thereof, so that the preceding sheet P sent to the first sheet discharge tray 16 is not pressed out by making contact with the front end of the succeeding sheet bundle T. Further, even if the preceding sheet bundle T is slightly displaced by the succeeding sheet P, since the first sheet discharge tray 16 is arranged in a tilted manner, the sheet bundle T drops by its own weight on the shutter 86 side and is loaded on the first sheet discharge tray 16 with the rear end thereof aligned at the point of contact with the shutter 86.

Next, a case where the staple processing which is a post-processing is to be performed and preceding sheets P in execution of the staple processing remain on the processing tray 12 will be described. At this time, the standby tray 10 slides and moves the tray members 10*a* and 10*b* from the position indicated by the dashed line in FIG. 12 respectively in the opposite direction of the direction of the arrow m and in the opposite direction of the direction of the arrow n, and is moved to the position indicated by the solid line shown in FIG. 12, and can support the sheet P. The standby tray rollers 28 are shifted above the standby tray 10 so as not to disturb the sheets P. The sheets P discharged from the image forming apparatus 5 and fed by the sheet feed rollers 24 are loaded once on the standby tray 10 to wait for the processing tray 12 to be free.

After the sheets P are loaded on the standby tray 10, the standby tray rollers 28 are moved down onto the standby tray 10 and are rotated in the opposite direction of the direction of the arrow f. As a result, the sheets P are sent toward the standby stoppers 10*c* and 10*d* and are vertically aligned with the rear end of the sheets P brought into contact with the standby stoppers 10*c* and 10*d*.

Since the standby tray 10 is arranged in a tilted manner, a force in the direction of the standby stoppers 10*c* and 10*d* is applied to the sheets P by the own weight. Thus, even if, for example, the succeeding sheet P is fed from the sheet feed rollers 24 in a state that it is curled convexly and is fed to the standby tray 10, the preceding sheet P loaded on the standby tray 10 is not pressed out by making contact with the front end of the succeeding sheet P. Namely, the fed sheet P is sequentially loaded on the standby tray 10 unless the order is disturbed. Further, even if the preceding sheet P is pressed by the succeeding sheet P and is slightly displaced, since the standby tray 10 is arranged in a tilted manner, the sheet P drops by its own weight down to the position where the rear end thereof is brought into contact with the standby stoppers 10*c* and 10*d* and is loaded on the standby tray 10 with the rear end aligned.

Figure 12:
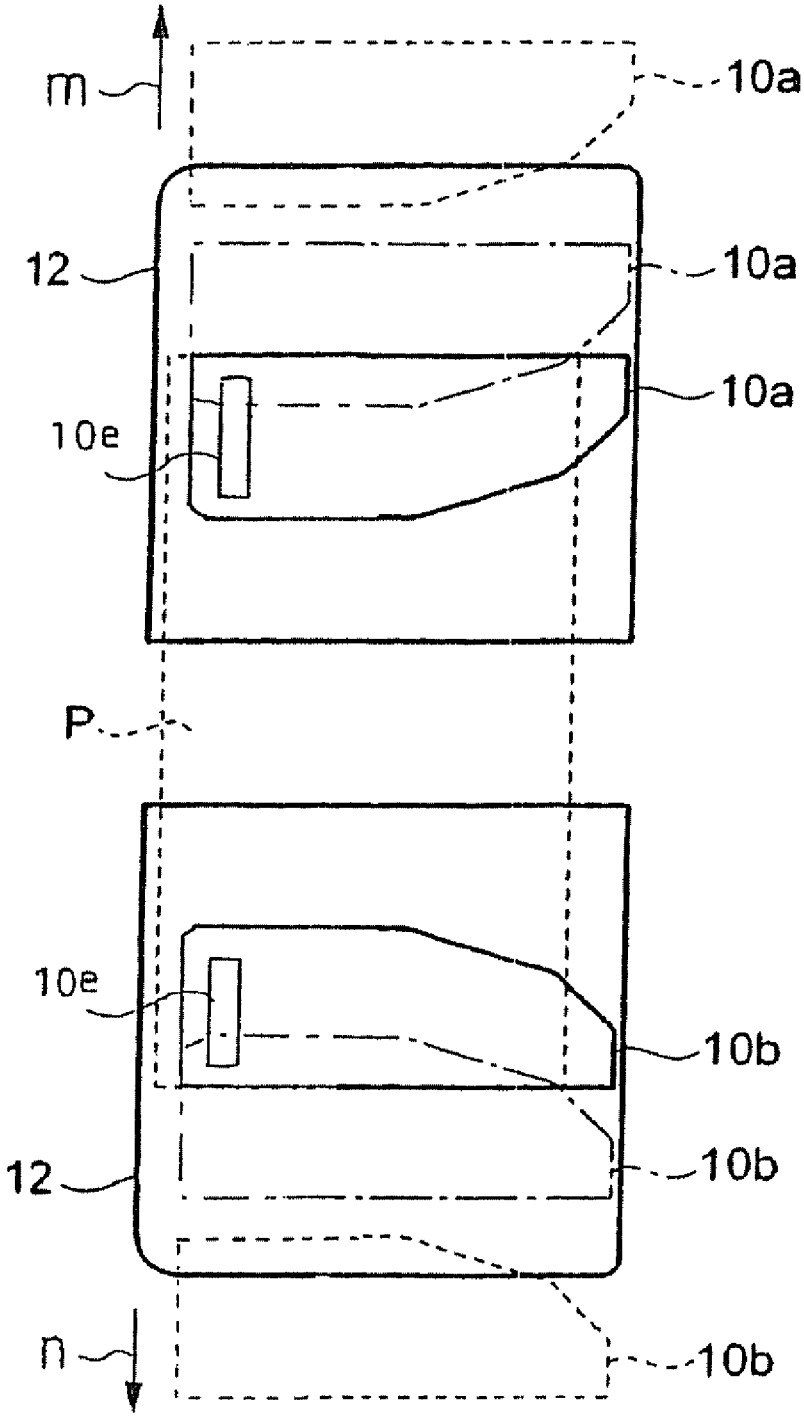
FIG. 12 is an explanatory view showing the movement of the standby tray according to the embodiment of the present invention.

During this period, when the preceding sheet P on the processing tray 12 is discharged on the side of the first sheet discharge tray 16 and the processing tray 12 becomes free, the standby tray 10 slides and moves the tray members 10*a* and 10*b* respectively up to the positions indicated by the dotted lines in FIG. 12 in the directions of the arrows m and n from the position indicated by the solid line in FIG. 12 via the position indicated by the alternate long and short dash line in FIG. 12. By doing this, for example, two sheets P standing by on the standby tray 10, when the tray members 10*a* and 10*b* reach the position indicated by the alternate long and short dash line in FIG. 12, are dropped and supplied onto the processing tray 12 from between the tray members 10*a* and 10*b*. At this time, the horizontal alignment plates 47*a* and 47*b* are arranged so as to make the interval between them almost equal to the width of the sheets P. Therefore, the sheets P dropped from the standby tray 10 are controlled on both sides by the horizontal alignment plates 47*a* and 47*b* and are aligned horizontally.

The lower side sheet P of the two sheets P dropped onto the processing tray 12 is sent in the direction of the arrow q by the lower vertical alignment roller 38*b* rotated in the opposite direction of the direction of the arrow s, and the rear end of the sheet P is brought into contact with the stopper 45, and the vertical alignment of the sheet P is accomplished. The upper side sheet P of the two sheets P dropped onto the processing tray 12 is sent in the direction of the arrow q by the upper vertical alignment roller 38*a* rotated in the opposite direction of the direction of the arrow r, and the rear end of the sheet P is brought into contact with the stopper 45, and the vertical alignment of the sheet P is accomplished. Thereafter, the upper vertical alignment roller 38*a* is shifted upward.

The third and subsequent sheets P discharged from the image forming apparatus 5 are directly dropped and supplied onto the processing tray 12 from between the tray members 10*a* and 10*b* without standing by on the standby tray 10. Thereafter, the third and subsequent sheets P are sequentially aligned on the sheets P loaded earlier on the processing tray 12 by the paddle 44.

When the sheets P loaded on the processing tray 12 reach a predetermined number, the sheets P are stapled by the stapler 14 to form a sheet bundle T. Thereafter, the sheet bundle T is fed toward the first sheet discharge tray 16 by the upper and lower vertical alignment rollers 38*a* and 38*b*. When the rear end of the sheet bundle T passes the upper and lower vertical alignment rollers 38*a* and 38*b*, it is hooked by the feed pawl 50*a* of the conveyor belt 50 and is sent to the first sheet discharge tray 16. At this time, the alignment rollers 61 are rotated in the direction of the arrow h. As a result, the sheet bundle T is fed onto the sheet discharge tray 16.

Since the conveyer belt 50 and alignment rollers 61 use the same shaft 60, they are always driven at the same time. That is, the feeding forces supplied from the conveyer belt 50 and alignment rollers 61 are continued to be applied to the sheet bundle T. As a result, the sheet bundle T is smoothly and stably fed by means of both the conveyer belt 50 and alignment rollers 61 onto the sheet discharge tray 16 or 18.

When the first sheet discharge tray 16 is full while the sheet bundles T are sequentially discharged, subsequent sheet bundles T are discharged onto the second sheet discharge tray 18 in place of the first sheet discharge tray 16. In order for the sheet bundle T to be discharged onto the second sheet discharge tray 18, the first and second sheet discharge trays 16 and 18 are slid in the direction of the arrow j. At this time, the movable portions 88 of the shutter 86 are extended in the i direction denoted by the arrow in FIG. 11 to close the sheet discharge sections of the processing tray 12 and standby tray 10, as shown in FIG. 3B.

Therefore, it is possible to prevent the sheet bundle T placed on the first sheet discharge tray 16 from reversely being fed to the processing tray 12 or standby tray 10 when the first sheet discharge tray 16 passes the sheet discharge section of the processing tray 12 or standby tray 10. After the second sheet discharge tray 18 is slid up to the position corresponding to the sheet discharge section of the processing tray 12, the movable portions 88 of the shutter 86 are contracted to the position shown in FIG. 10. That is, the movable portions are positioned below the sheet discharge section of the processing tray 12 to open the sheet discharge section of the processing tray 12. In this state, the sheet bundle T can be discharged from the processing tray 12 onto the second sheet discharge tray 18.

In this embodiment having such a configuration, when the staple processing is to be performed after image forming and the preceding staple processing is not finished on the processing tray 12, the standby tray 10 installed above the processing tray 12 waits for the succeeding sheets P. Thereafter, after the processing tray 12 becomes free, the sheets P standing by on the standby tray 10 are dropped and supplied and then are moved onto the processing tray 12. Therefore, the practical feeding path from the standby tray 10 to the processing tray 12 in the sheet post-processing apparatus 7 can be shortened and the sheet post-processing apparatus 7 can be miniaturized.

Further, the center upper portions 86*a* of the shutter 86, which support the rear end of the sheet P discharged onto the sheet discharge tray 16 or 18 are located lower than the peripheral upper portions 86*b*. Therefore, the sheet P can contact the center alignment rollers 61*a* without fail on the processing tray 12 without being obstructed by the shutter 86. As a result, the vertical alignment of the sheet P on the processing tray 12 can be achieved. Further, even when the movable members 88 of the shutter 86 are extended up to the position corresponding to the sheet discharge section of the standby tray 10, the center upper portions 86*a* are located lower than the peripheral upper portions 86*b*. Therefore, even if the sheet P is discharged from the standby tray 10 in a state where its center portion in the feeding direction is deformed, the deformed portion is not brought into contact with the shutter 86, thereby avoiding jamming of the sheet P.

Further, in the present embodiment, the alignment rollers 61 and conveyer belt 50 have the same shaft 60. That is, the feeding forces supplied from the conveyer belt 50 and alignment rollers 61 are continued to be applied to the sheet bundle T. As a result, the sheet bundle T is effectively be discharged onto the sheet discharge tray 16 or 18. Further, the movable members 88 of the shutter 86 are extended while the sheet discharge trays 16 and 18 are slid to close the sheet discharge sections of the processing tray 12 and/or standby tray 10. Therefore, it is possible to prevent the sheet P placed on the first sheet discharge tray 16 from reversely being fed to the processing tray 12 or standby tray 10 while the first sheet discharge tray 16 is slid.

The present invention is not limited to the above embodiment and various modifications are possible within the scope of the invention. For example, a method of dropping and supplying the sheet P from the standby tray to the processing tray is not limited to one based on the slide movement but may be implemented by a rotational movement. Further, the post-processing is not limited to the staple processing, but may be any processing, such as hole-punching processing in sheets, as far as it is post-processing to be applied to the sheet.

The values of the width of the center area of the rear end supporting mechanism and difference in the vertical position between the center area and peripheral area thereof is not limited, and they may be set to any value as far as they fall within a range where the rear end of the sheet on the sheet discharge tray can appropriately be supported, where the alignment rollers can be in contact with the back surface of the sheet without fail, and where the deformed portion is not brought into contact with the rear end supporting mechanism when the sheet is discharged onto the sheet discharge tray. Further, a drive means for moving the movable sections of the rear end supporting mechanism may have any configuration.

What is claimed is:

1. A sheet post-processing apparatus comprising:

a standby tray having a pair of tray members to be able to move to make a sheet discharged from an image forming apparatus stand by;

a processing tray arranged under the standby tray;

a paddle configured to beat down a sheet from the standby tray to the processing tray;

a processing mechanism to perform post-processing for the sheet;

a sheet discharge tray to load the sheet, the sheet discharge tray tilted such that the discharge direction front end of the sheet is positioned higher than the discharge direction rear end thereof;

a feed pawl to discharge, via a discharge path, the sheet from the processing tray to the discharge tray;

a plurality of ejection rollers to discharge the sheet from the processing tray to the discharge tray;

a motor to drive the plurality of ejection rollers in a first direction and in a second direction, where the second direction is counter to the first direction;

a rear end supporting mechanism arranged on the discharge direction rear end side of the sheet discharge tray, where the rear end supporting mechanism has stationary portions and movable portions that can slide to extend upwardly from the stationary portions; and an electromagnetic clutch forming part of a drive link mechanism between the motor and the movable portions, wherein when the electromagnetic clutch is on and the ejection rollers are rotated in the first direction by the motor, the movable portions are driven to a first position to facilitate discharge of the sheet along the discharge path, and wherein when the electromagnetic clutch is on and the ejection rollers are rotated in the second direction by the motor, the movable portions are driven to a second position where the movable portions block the discharge path to prevent a rear end of a sheet on the discharge tray from contact with the ejection rollers.

2. The sheet post-processing apparatus according to claim 1, wherein during the second direction of rotation of the ejection rollers moved in conjunction with a slide movement of the sheet discharge tray is moved.

3. The sheet post-processing apparatus of claim 1, an upper end of a center area of the rear end supporting mechanism which is opposite to the feed pawl is positioned lower than a peripheral area upper end of the rear end supporting mechanism.

4. The sheet post-processing apparatus according to claim 3, wherein the plurality of ejection rollers comprise:

center alignment rollers which are arranged at one end of the processing tray on the sheet discharge tray side;

side alignment rollers, which are arranged on both sides of the center alignment rollers, the center alignment rollers and the side alignment rollers located on the same shaft; and a sheet discharge mechanism to discharge the sheet from the processing tray to the sheet discharge tray.

5. The sheet post-processing apparatus according to claim 4, wherein the center area of the rear end supporting mechanism is the area that faces the center alignment rollers.

6. The sheet post-processing apparatus according to claim 4, wherein the center alignment rollers and side alignment rollers are rotated in the second direction when vertically aligning the sheet on the processing tray, while rotated in the first direction when discharging the sheet from the processing tray to the sheet discharge tray.

7. The sheet post-processing apparatus according to claim 4, wherein the sheet discharge mechanism is a carrier belt to feed the sheet on the processing tray toward the sheet discharge tray, and the center alignment rollers are a pair of center alignment rollers which are disposed symmetrically with respect to the conveyor belt.

8. A sheet post-processing apparatus comprising:

a standby tray having a pair of tray members be able to move to make a sheet discharged from an image forming apparatus stand by;

a processing tray arranged under the standby tray;

a paddle configured to beat down a sheet from the standby tray to the processing tray;

a processing mechanism to perform post-processing for the sheet;

a sheet discharge tray to load the sheet, the sheet discharge tray tilted such that the discharge direction front end of the sheet is positioned higher than the discharge direction rear end thereof;

a sheet discharge mechanism to discharge the sheet from the processing tray to the sheet discharge tray via a discharge path, the sheet discharge mechanism has a feed pawl to discharge the sheet from the processing tray to the discharge tray;

alignment rollers which are arranged at one end of the processing tray on the sheet discharge tray side and configured to be rotatable by a shaft to rotate the sheet discharge mechanism;

a motor to drive the plurality of alignment rollers in a first direction and in a second direction, where the second direction is counter to the first direction;

a rear end supporting mechanism arranged on the discharge direction rear end side of the sheet discharge tray, where the rear end supporting mechanism has stationary portions and movable portions, and an electromagnetic clutch forming part of a drive link mechanism between the motor and the movable portions, wherein when the electromagnetic clutch is on and the alignment rollers are rotated in the first direction by the motor, the movable portions are driven to a first position to facilitate discharge of the sheet along the discharge path, and wherein when the electromagnetic clutch is on and the alignment rollers are rotated in the second direction by the motor, the movable portions are driven to a second position where the movable portions block the discharge path to prevent a rear end of a sheet on the discharge tray from contact with the alignment rollers.

9. The sheet post-processing apparatus according to claim 8, wherein the sheet discharge mechanism is a carrier belt to feed the sheet on the processing tray toward the sheet discharge tray, and the alignment rollers are rotated in the second direction when vertically aligning the sheet on the processing tray.

10. The sheet post-processing apparatus of claim 8, an upper end of a center area of the rear end supporting mechanism which is opposite to the feed pawl is positioned lower than a peripheral area upper end of the rear end supporting mechanism.

11. The sheet post-processing apparatus according to claim 10, wherein the center area of the rear end supporting mechanism has stationary portions and movable portions that can be extended upwardly from the stationary portion, the movable portions being moved in conjunction with the rotation of the shaft.

12. The sheet post-processing apparatus according to claim 11, wherein the movable portions are moved in conjunction with a slide movement of the sheet discharge tray.

13. A sheet post-processing apparatus comprising:

a standby tray having a pair of tray members to be able to move to make a sheet discharged from an image forming apparatus stand by;

a processing tray arranged under the standby tray;

a paddle configured to beat down a sheet from the standby tray to the processing tray;

a processing mechanism to perform post-processing for the sheet;

a sheet discharge tray to load the sheet, the sheet discharge tray tilted such that the discharge direction front end of the sheet is positioned higher than the discharge direction rear end thereof;

a feed pawl to discharge, via a discharge path, the sheet from the processing tray to the discharge tray; and a plurality of ejection rollers to discharge the sheet from the processing tray to the discharge tray;

a rear end supporting mechanism arranged on the discharge direction rear end side of the sheet discharge tray, where the rear end supporting mechanism has stationary portions and movable portions that can be extended upwardly from the stationary portions; and an electromagnetic clutch forming part of a drive link mechanism between the motor and the movable portions, wherein when the electromagnetic clutch is on and the ejection rollers are rotated in the first direction by the motor, the movable portions are driven to a first position to facilitate discharge of the sheet along the discharge path, and wherein when the electromagnetic clutch is on and the ejection rollers are rotated in the second direction by the motor, the movable portions are driven to a second position where the movable portions block the discharge path to prevent a rear end of a sheet on the discharge tray from contact with the ejection rollers.

14. The sheet post-processing apparatus according to claim 13, wherein the movable portions are moved in conjunction with the a slide movement of the sheet discharge tray.

15. The sheet post-processing apparatus of claim 1, an upper end of a center area of the rear end supporting mechanism opposite to the feed pawl is positioned lower than an upper end of a peripheral area of the rear end supporting mechanism.

* * * * *